US006321696B1

(12) United States Patent
Nishioka et al.

(10) Patent No.: US 6,321,696 B1
(45) Date of Patent: Nov. 27, 2001

(54) THERMOSTAT TROUBLE DIAGNOSIS SYSTEM IN AN ENGINE COOLING SYSTEM

(75) Inventors: Futoshi Nishioka; Tetsushi Hosokai; Seiji Makimoto, all of Hiroshima-Ken (JP)

(73) Assignee: Mazda Motor Corporation (JP)

( * ) Notice: Subject to any disclaimer, the term of this patent is extended or adjusted under 35 U.S.C. 154(b) by 0 days.

(21) Appl. No.: 09/620,971

(22) Filed: Jul. 20, 2000

(30) Foreign Application Priority Data

Aug. 31, 1999 (JP) ..... 11-245279

(51) Int. Cl.[7] ..... F01P 5/14
(52) U.S. Cl. ..... 123/41.15; 73/118.1
(58) Field of Search ..... 123/41.15; 73/118.1

(56) References Cited

U.S. PATENT DOCUMENTS 4,069,712 * 1/1978 Armstrong et al. ..... 73/118.1
5,526,871 6/1996 Musser et al. .
6,128,948 * 10/2000 Shi et al. ..... 73/118.1

FOREIGN PATENT DOCUMENTS 44 26 494 A1 2/1996 (DE) .
10184433 7/1998 (JP) .
10-220639 * 8/1998 (JP) .
11-153032 * 6/1999 (JP) .

* cited by examiner

*Primary Examiner*—Noah P. Kamen
(74) *Attorney, Agent, or Firm*—Nixon Peabody LlP; Donald R. Studebaker

(57) ABSTRACT

The invention relates to an apparatus for diagnosing thermostat trouble in an engine cooling system comprising a thermostat which works to open a valve to make a cooling water flow through a radiator when the cooling water temperature for an engine becomes more than a predetermined temperature, or to close the valve to make the cooling water bypass a radiator when this temperature becomes less than the predetermined temperature. The apparatus comprises means for calculating a radiation heat amount from a radiator received by the cooling water for the engine and means for determining whether the thermostat trouble has occurred based on the radiation heat amount calculated by the means for calculating the radiation heat amount.

12 Claims, 6 Drawing Sheets

THERMOSTAT TROUBLE DIAGNOSIS SYSTEM IN AN ENGINE COOLING SYSTEM

BACKGROUND OF THE INVENTION

1. Field of the Invention

The present invention relates to an apparatus for diagnosing a thermostat trouble in an engine cooling system.

2. Description of the Background Art

In the engine cooling system, a radiator and a thermostat (a thermostat valve) are provided. This thermostat is opened or closed in response to a cooling water temperature. It is opened when the cooling water temperature for the engine becomes more than a predetermined temperature (ex. 80° C.), whereby the cooling water flows through a radiator to be cooled by the radiator. The thermostat is closed when the cooling water temperature becomes less than the predetermined temperature, whereby the cooling water bypasses the radiator so that the cooling water temperature may rise rapidly.

However, the cooling water temperature will not rise rapidly if the thermostat is caused to remain open (an opening lock) due to a problem with the thermostat. In this case the cooling water flows through the radiator and thus the engine would be actuated under a cold condition. This condition is not suitable for keeping the engine operation stable nor for improving specific fuel consumption and taking measures regarding exhaust gas.

To determine whether the thermostat trouble has occurred, Japanese Public Disclosure No.Hei 10-184433 discloses the thermostat trouble detecting device for detecting whether the actual cooling water temperature is less than the predetermined temperature a predetermined number of hours after the engine starts, namely, whether the opening trouble has occurred.

However, the above device is likely to cause the incorrect determination that a opening trouble has occurred even though actually the thermostat is not out of order, since the cooling water temperature does not rise very much even if the cooling water is not cooled by the radiator when an operating condition under which there is a small heat amount from the engine such as an idling operation continues after the engine starts.

To prevent the above incorrect determination, the present inventors developed an apparatus that determines that the opening trouble has occurred when an integrating value of deviation between the predicted cooling water temperature and the actual cooling water temperature detected by a temperature sensor is more than the predetermined temperature at the point that the cooling water temperature predicted based on the engine operating condition reaches the predetermined temperature. According to the device for determining, the incorrect determination that the thermostat opening trouble has occurred can be prevented since it takes a longer time until the predicted temperature reaches the predetermined temperature even if an operating condition under which there is a small heat amount from the engine such as an idling operation continues after the engine starts.

However, in the device for determining using the predicted temperature as described above, the predicted temperature reaches the predetermined temperature for a short period if an operating condition under which the cooling water temperature rises rapidly continues, for example, if the acceleration of a vehicle up a steep ascent continues directly after the engine starts, and thus the determining device is likely to determine incorrectly that the thermostat is normal since the integrating value becomes small even if the opening trouble occurs.

OBJECTS AND SUMMARY OF THE INVENTION

The present invention overcomes the above problems. It is an object of the present invention to provide an apparatus for diagnosing a thermostat trouble in an engine cooling system to be able to determine more precisely whether the thermostat trouble has occurred.

The present invention includes an apparatus for diagnosing a thermostat trouble in an engine cooling system including a thermostat which opens a valve to direct a cooling water to flow through a radiator when the cooling water temperature for an engine becomes more than a predetermined temperature, and closes the value to direct the cooling water to bypass the radiator when the temperature becomes less than the predetermined temperature with the apparatus including a mechanism for calculating a radiation heat amount from a radiator based on a predicted cooling water temperature calculated by using operating parameters indicating a condition of the engine operation and an actual cooling water temperature detected by a detector for detecting a temperature of the water, and based on an integrated value of deviation between the predicted temperature and the actual temperature, and a deviation between a present predicted temperature and the actual temperature, and a mechanism for determining whether the thermostat trouble has occurred based on a result of a comparison between the actual or predicted temperature and the predetermined temperature and the radiation heat amount calculated by the calculating mechanism.

Further, the present invention may include a second calculating mechanism for calculating the heat amount from the engine received by the cooling water for the engine, wherein the detector is configured to determine whether the thermostat trouble has occurred based on a relation between the radiation heat amount and the received heat amount.

The integrated value is a value derived from multiplying the deviation between the predicted temperature and the actual temperature by a vehicle speed wherein the second calculating mechanism calculates the heat amount from the engine received by the cooling water for the engine with the determining mechanism being configured to determine if the thermostat trouble has occurred by comparing a ratio of the radiation heat amount to the received heat amount with a predetermined threshold for determination. Further, the determining mechanism may be configured to determine that thermostat trouble has occurred and that the valve has been left open when the predicted temperature or the actual temperature is less than an opening set temperature of the thermostat and when the ratio of the heat amount is more than the threshold for determination. Additionally, the determining mechanism may be configured to determine that the thermostat trouble has occurred and left the valve closed when the predicted temperature or the actual temperature is more than the opening set temperature of the thermostat and when the ratio of the heat amount is less than the threshold for determination.

Additionally, the present invention may include a mechanism for stopping the determination of whether the thermostat trouble has occurred by the determining mechanism when the cooling water temperature is less than the predetermined value or when the vehicle speed is less than the predetermined value.

Moreover, in accordance with the present invention, the apparatus for diagnosing thermostat trouble includes a controller which is configured to calculate a radiation heat amount from a radiator based on a predicted cooling water temperature calculated by using operating parameters indicating a condition of the engine operation and an actual cooling water temperature, and also based on an integrated value of deviation between the predicted temperature and the actual temperature, and a deviation between a present predicted temperature and the actual temperature and a mechanism for determining whether the thermostat trouble has occurred based on the result of a comparison between the actual or predicted temperature and a predetermined temperature, and the calculated radiation heat amount. The controller is further configured to calculate the heat amount received by the cooling water for the engine and determining whether the thermostat trouble has occurred based on a relation between the radiation heat amount and the received heat amount. Furthermore, when the integrated value is a value derived from multiplying the deviation between the predicted temperature and the actual temperature utilizing a vehicle speed, the controller is configured to calculate the heat amount from the engine received by the cooling water for the engine and determining if the thermostat trouble has occurred by comparing a ratio of the radiation heat amount to the received heat amount with a predetermined threshold for determination.

The controller may be further configured to determine that the thermostat trouble has occurred and left the valve in a open condition when the predicted temperature or the actual temperature is less than an opening set temperature of the thermostat and when the ratio of the heat amount is more than the threshold for determination. When the predicted temperature or the actual temperature is more than the opening set temperature of the thermostat and when the ratio of the heat amount is less than the threshold for determination. The controller may also be configured to determine that the thermostat is not normal and the valve is left in a closed condition. Additionally, the controller may be configured to stop the determination of whether the thermostat trouble has occurred when the cooling water temperature is less than the predetermined value or when the vehicle speed is less than the predetermined value.

These as well as additional advantages of the present invention will become apparent from the several figures when viewed in light of the detailed description.

BRIEF DESCRIPTION OF THE DRAWINGS

The teachings of the present invention can be readily understood by considering the following detailed description in conjunction with the accompanying drawings, in which.

DETAILED DESCRIPTION OF THE INVENTION

Figure 1:
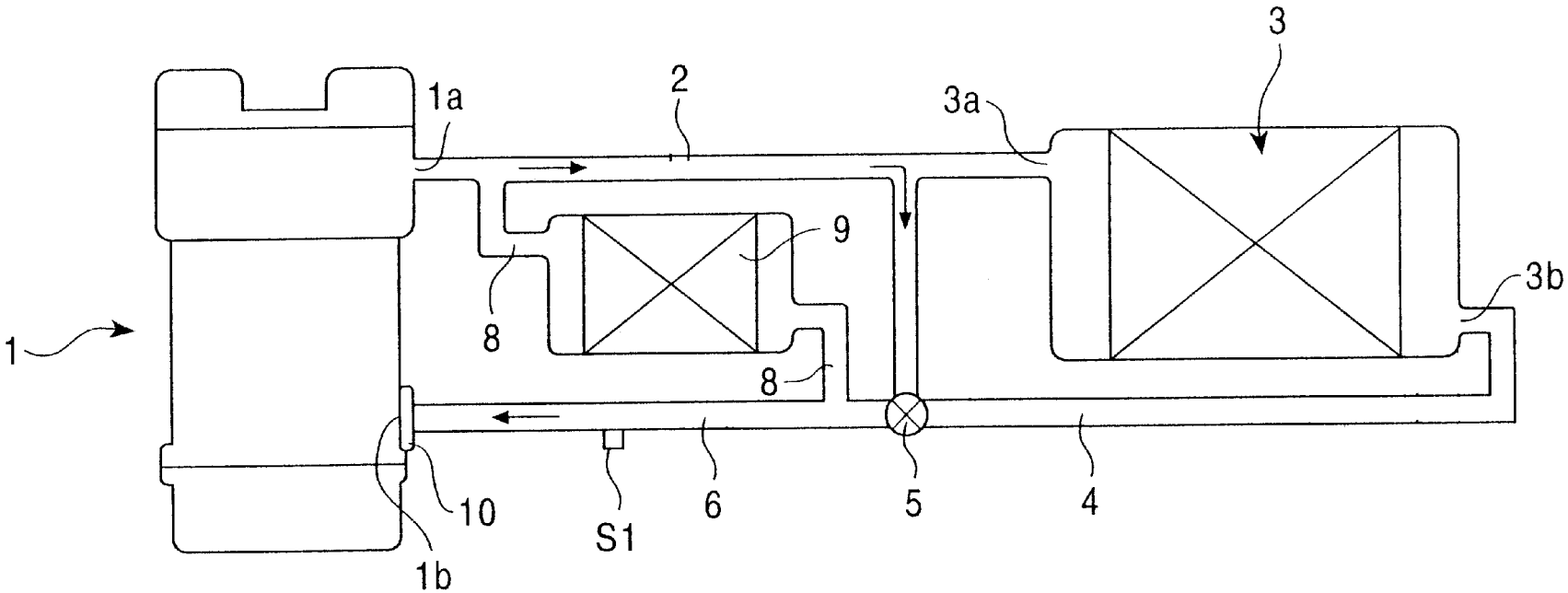
FIG. 1 is a schematic view illustrating one embodiment of an engine cooling system.

Referring to FIG. 1, a reference numeral 1 indicates an engine for a vehicle, while an outlet of a cooling water path is indicated at 1*a* and an inlet of the cooling water path is indicated at 1*b*. The outlet 1*a* is connected to a cooling water inlet 3*a* of a radiator 3 via a pipeline 2. A cooling water outlet 3*b* of the radiator 3 is connected to a thermostat 5 via a pipeline 4 and this thermostat 5 is connected to the cooling water inlet 1*b* of the engine 1 via a pipeline 6. The pipeline 2 is connected to the thermostat 5 via a pipeline 7 to enable the radiator 3 to be bypassed. The pipeline 2 and the pipeline 6 are connected to a pipeline 8 to enable the radiator 3 and the pipeline 7 to be bypassed, and a heater core 9 is connected to the pipeline 8. A pump 10 for providing the engine 1 with the cooling water is connected to the pipeline 6.

Figure 2:
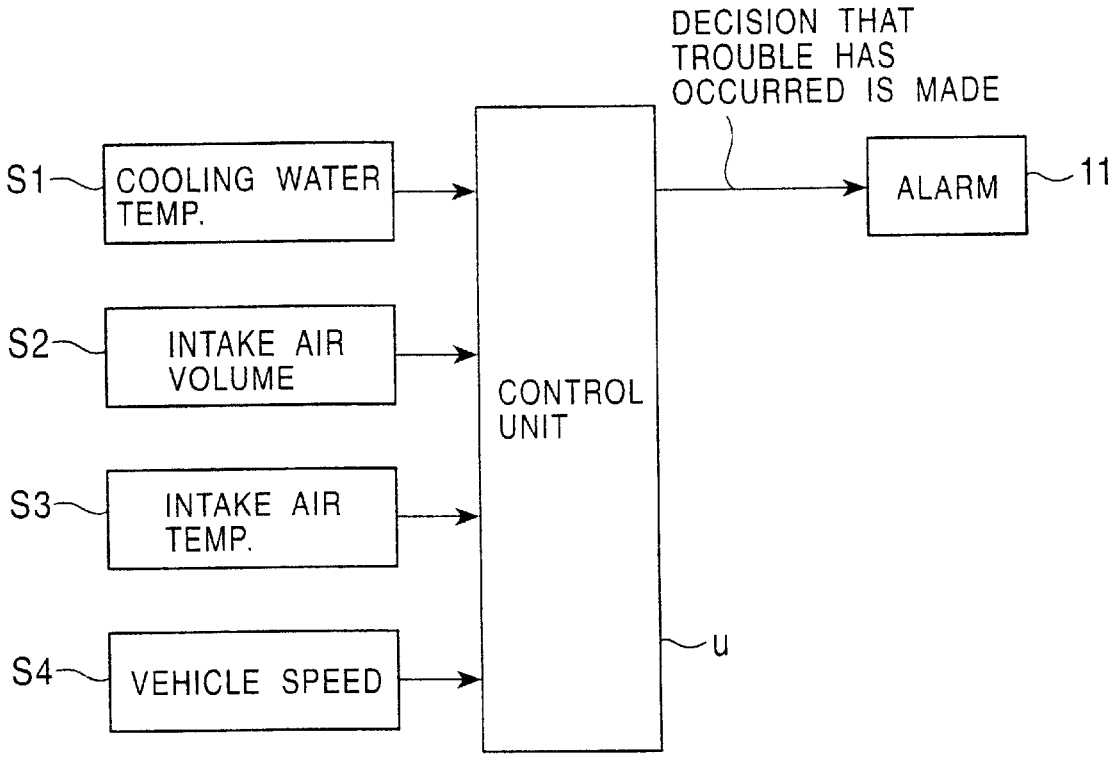
FIG. 2 is a schematic view illustrating a control system for determining if a trouble has occurred.

The thermostat 5 comprises a three way switching valve, which is opened to connect the pipeline 6 with the pipeline 4 and disconnect the pipeline 6 from the pipeline 7 as a temperature of the cooling water which flows through the thermostat 5 reaches a predetermined opening temperature (ex.80° C.). When the thermostat 5 is opened this way, the cooling water at a high temperature made to flow from the engine 1 to the pipeline 2 is supplied to the engine 1 through the pipelines 4, 6 again after having flowed through the radiator 3 to be cooled there. In addition, the thermostat 5 is closed to connect the pipeline 6 with the pipeline 7 and disconnect the pipeline 6 from the pipeline 4 as the temperature of the cooling water which flows through the pipeline 6 becomes less than the predetermined temperature (the cooling water flow condition at this time is indicated by arrows in FIG. 1). When the thermostat 5 is closed this way, the cooling water made to flow from the engine 1 to the pipeline 2 is circulated from the pipeline 6 to the engine 1 through the pipeline 7, thereby bypassing the radiator 3. A blower may work to exchange heat between the heater core 9 and inside air as the room is heated, and a gate valve may be installed to prevent the cooling water from passing through the pipeline 8 as the room is not heated. FIG. 2 illustrates a control system for detecting (determining) whether the thermostat opening trouble has occurred, U in the FIG. 2 being a control unit (a controller) employing a microcomputer. Signals from a variety of sensors S1 to S4 are input into this control unit U. The sensor S1 detects the cooling water temperature, and is installed on the pipeline 6 to detect a temperature of the cooling water passing through the thermostat 5. (The water temperature sensor S1 can instead be installed in the thermostat 5.) The sensor S2 detects a volume of intake air supplied to the engine 1, namely, an engine load. The sensor S3 detects a temperature of the intake air supplied to the engine 1. The sensor S4 detects a vehicle speed. The control unit U determines if the thermostat opening trouble has occurred based on the output from the sensors as described below. The control unit makes an alarm 11 activate when it determines that the trouble has occurred.

Figure 3:
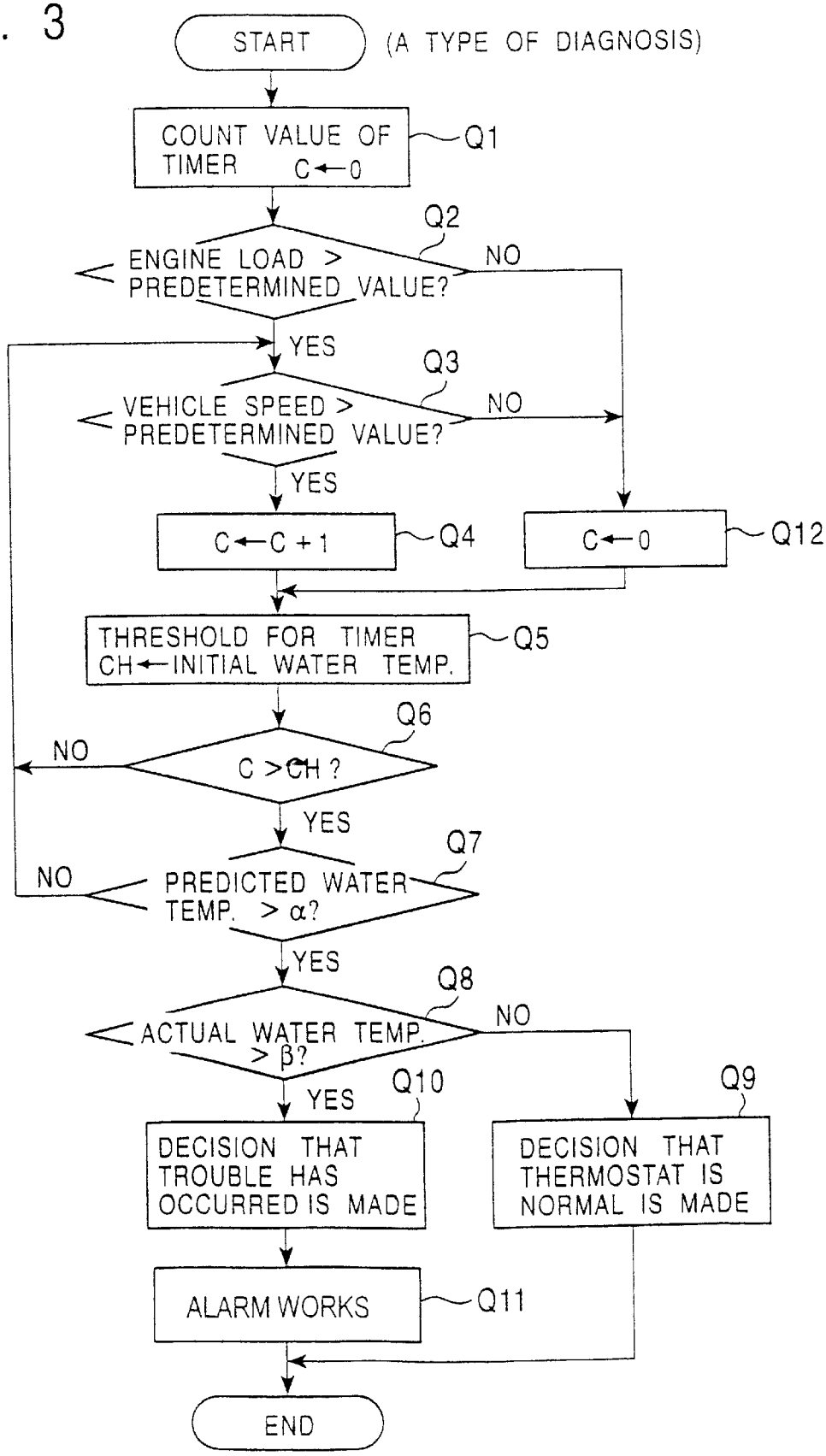
FIG. 3 is a flowchart illustrating an exemplary control in accordance with the present invention.
Figure 4:
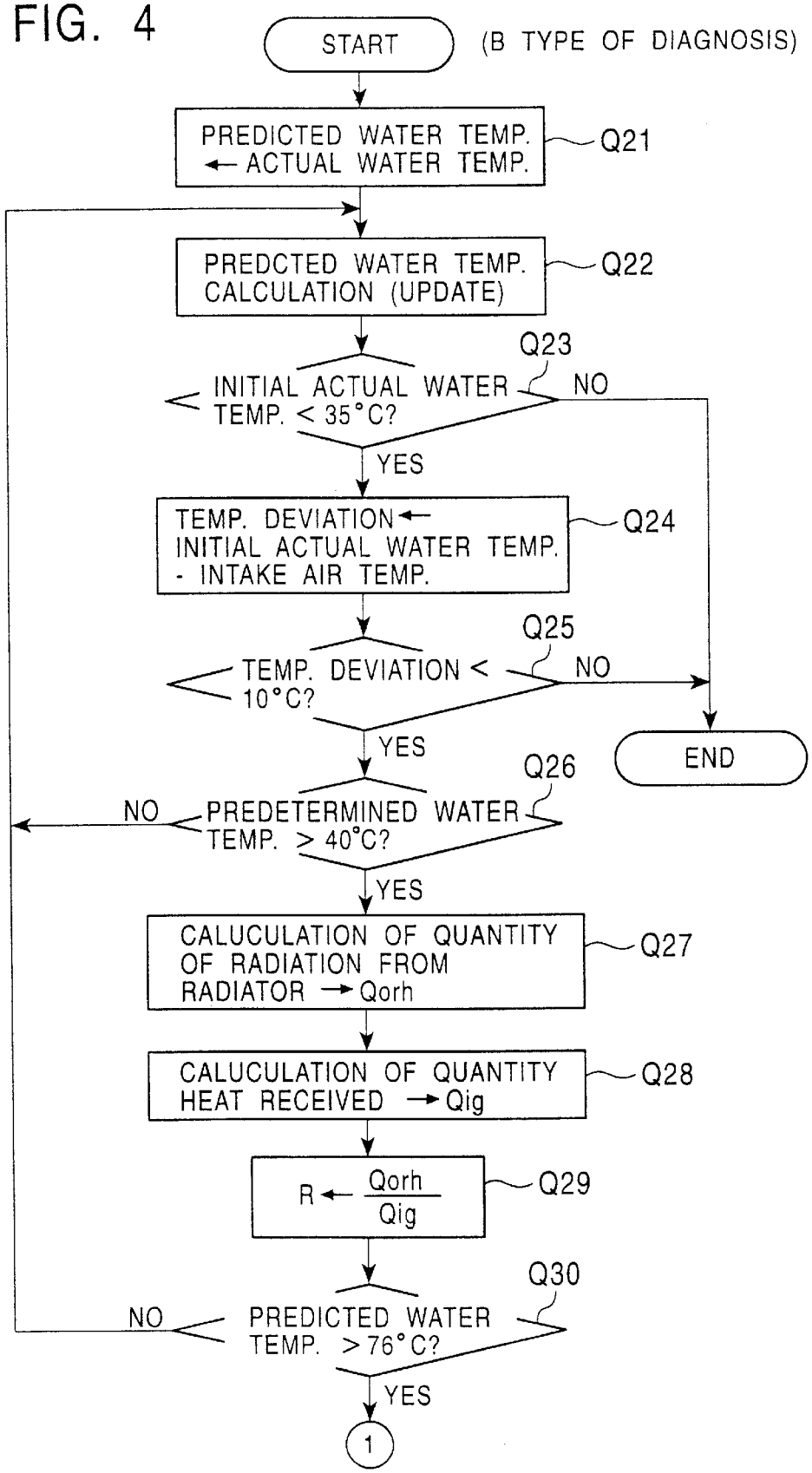
FIG. 4 is a flowchart illustrating an exemplary control in accordance with the present invention.
Figure 5:
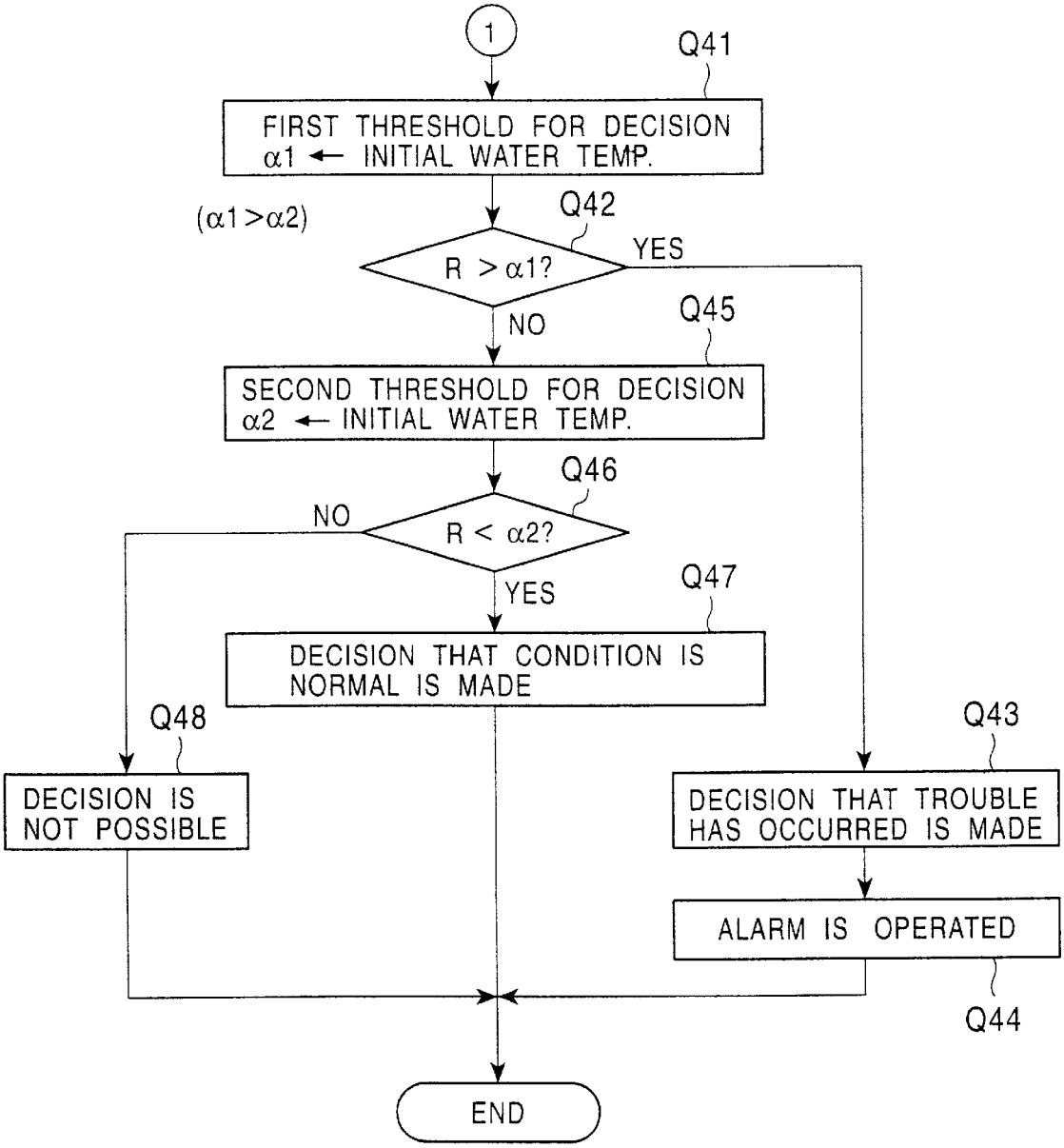
FIG. 5 is a flowchart illustrating an exemplary control in accordance with the present invention.
Figure 6:
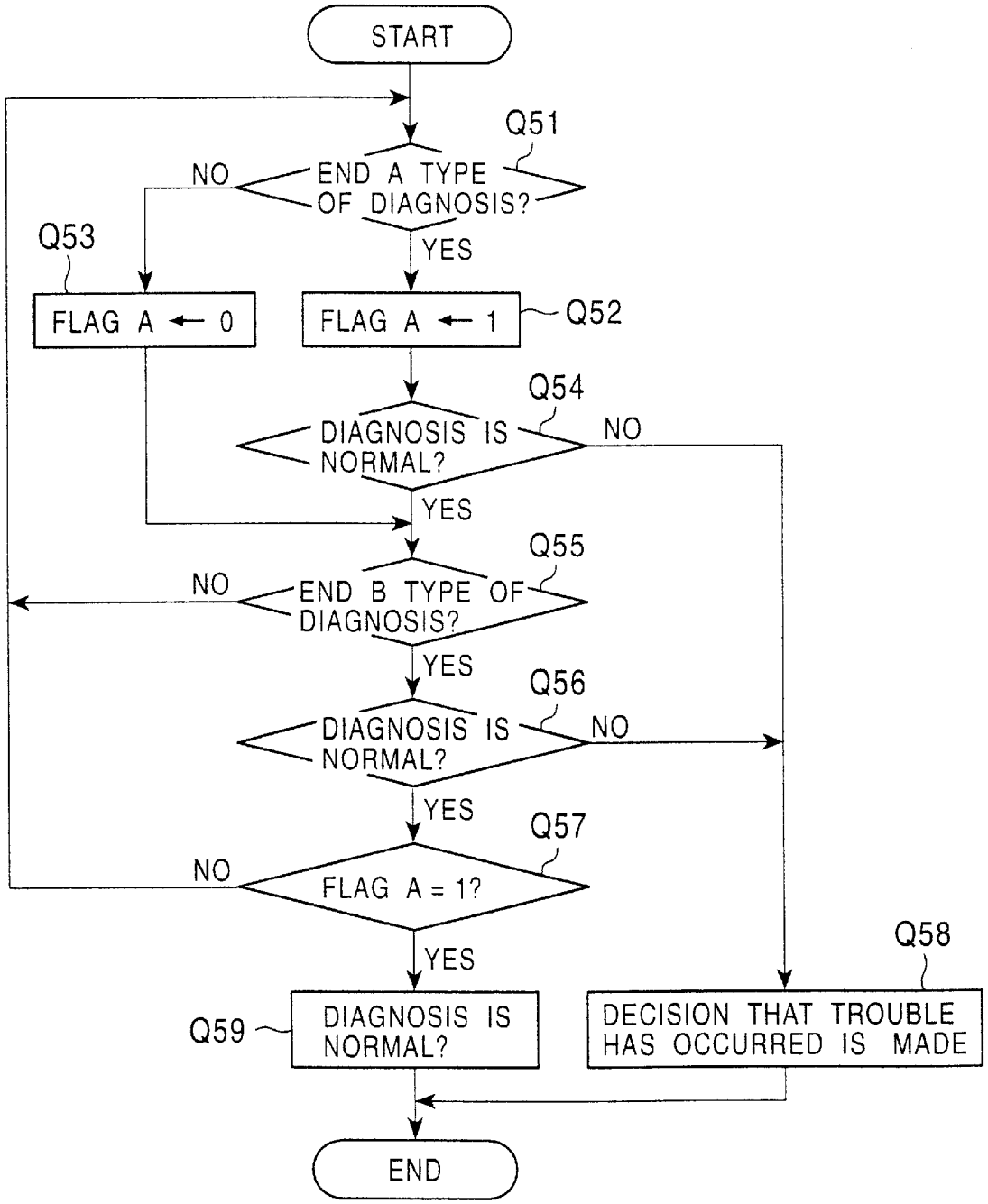
FIG. 6 is a flowchart illustrating an exemplary control in accordance with the present invention.

Referring to flowcharts in FIG. 3 to FIG. 6, the device for determining whether the trouble has occurred by the control unit U will be described. FIG. 3 illustrates an A type of device for determining whether the trouble has occurred (a method for diagnosing the trouble), and FIGS. 4, 5 illustrate a B type of device for determining whether the trouble has occurred (the method for diagnosing the trouble) in accordance with the present invention, and FIG. 6 illustrates device for determining whether the trouble has occurred finally incorporating therein the results obtained by both the A and B types of means. Q indicates the steps in the above device shown in FIGS. 3 to 6 and described below.

The A type of device for determining whether the trouble has occurred in FIG. 3 will now be described. The controller starts at the same time that the engine 1 starts, and a count value of a timer is initialized to zero in Q1. Then, the controller determines if the engine load is a higher load than a predetermined value in Q2. If YES in this Q2, the controller determines if the vehicle speed is a higher speed than a predetermined speed in Q3. If YES in this Q3, the count value of the timer will be counted in Q4.

In Q5, a predetermined time CH to be counted by the timer is set based on the cooling water temperature at the time of starting the engine. That is, the process in Q5 is carried out to compensate for the fact that the raising gradient of the cooling water temperature varies in response to the cooling water temperature even if operating conditions of the engine and the vehicle are the same. In Q6, the controller determines if the count value of the timer is more than the predetermined value (predetermined time) CH. Initially, the process flow returns to Q2 if the determination in Q6 is NO.

If YES in Q6, the controller determines if the predicted cooling water temperature predicted based on the operating condition of the engine 1 is more than the predetermined temperature α in Q7. In a preferred embodiment of the invention, the predicted cooling water temperature is calculated by adding the last predicted temperature and the temperature rising during a predetermined short period which is calculated employing the engine load (ex. intake air volume), the vehicle speed and the intake air temperature as parameters. (The initialized value of the predicted temperature is regarded as the actual cooling water temperature detected at the time of starting the engine.) The predetermined temperature α, which is less than a opening set temperature of the thermostat 5, is close to that in the preferred embodiment. The predicted cooling water temperature is calculated in accordance with an exemplary differential equation (13) as follows. That is, it is assumed that the predicted cooling water temperature θep is equal to the actual cooling water temperature θea (θep=θea) at the time that the calculation start time t=0 and θep(0)=θea(0), and an initialized value is set. Then, the heat amount per hour qig transferred from burning gas to the cooling water is calculated based on a measured intake air volume gf and also k(Vs) is calculated based on the vehicle speed Vs. A change ratio of the predicted water temperature dθep/dt(deg/s) is calculated by assigning these values, an intake air temperature θ ia and a constant CM to the equation (13). The predicted water temperature θ ep is calculated by calculating repeatedly in accordance with the following equation based on the change ratio of the predicted water temperature.

$$\theta ep(t+1) = \theta ep(t) + \Delta t \times \frac{d(\theta ep(t))}{dt}$$

If YES in Q7, the controller determines if the actual cooling water temperature detected by the sensor S1 is less than the predetermined temperature β in Q8. This predetermined temperature β, which is less than the opening set temperature of the thermostat 5, is set to correspond to the predetermined temperature α. In the preferred embodiment, the predetermined temperature β is set to be close to the opening temperature and slightly lower than the temperature α. (β can also set at the same temperature as α.) If NO in Q8, the controller determines that the thermostat is normal in Q9 since this NO in Q8 means that the actual cooling water temperature is a sufficiently high temperature, i.e. the cooling by the radiator 3 was not carried out and the opening trouble which causes the thermostat 5 to be left open at a much lower temperature than the opening set temperature has not occurred. If YES in Q8, the controller determines that the opening trouble has occurred in Q10 and the alarm 11 is operated in Q11.

If NO in Q2 or NO in Q3, the count value of the timer will be reset to zero in Q12. Thus, the controller is set to determine that the opening trouble has occurred when the high load and high speed continues during more than the predetermined time. The continuation of the high load and high speed condition during more than the predetermined time includes that the total time integrated time of the high load and high vehicle speed is equal to the above predetermined time. (Q12 step in FIG. 3 is not required as the condition of the high load and high speed continues.)

Referring to the flowcharts in FIGS. 4, 5, the B type of means used in conjunction with the present invention will be described. In Q 21 in FIG. 4, the actual cooling temperature detected by the sensor S1 is set at the predicted cooling water temperature. Subsequently, the predicted cooling water temperature is calculated in Q22, which temperature is calculated employing the engine load, the vehicle speed and intake air temperature as parameters as well as the calculation of the predicted cooling water temperature in FIG. 3.

The controller determines if the actual cooling water temperature at the time of starting the engine is quite low, for example 35° C., in Q23. If NO in Q23, the process flow will end since this means that a determination that a trouble has occurred is not required. If YES in Q23, the controller determines if a temperature deviation which is the result of a subtraction of the intake air temperature from the actual cooling water temperature at the time of starting the engine is a sufficiently low value such as 10° C., in Q24. If NO in Q25, the process flow will end since this means that a determination that the trouble has occurred is not required. Eventually, the above processes in Q23, Q25 are such that the determination that a trouble has occurred is not made once the cooling water reaches quite a high temperature by driving the engine 1 (so as to make the determination that a trouble has occurred based on the cooling water temperature rising from an almost cool condition).

If YES in Q25, the controller determines if the predicted cooling water temperature is more than the predetermined temperature set at an intermediate temperature such as 40° C. in Q26. If NO in Q26, the process flow returns to Q22. If YES in Q26, the radiation heat amount Qorh from the radiator 3 is calculated in Q27 as described below. Then, the received heat amount Qig from the cooling water engine 1 is calculated in Q28 as described below. In Q29, the ratio of heat amount R which is the ratio of the radiation heat amount Qorh to the received heat amount Qig is calculated. The greater this ratio of heat amount R is, the higher the possibility that the cooling water is cooled by the radiator 3. In Q30, the controller determines if the predicted cooling water temperature is less than the opening set temperature and is more than the predetermined temperature (ex. 76° C.) set to be close to this opening temperature. If NO in Q30, the process flow returns to Q22.

If YES in Q30, the process flow proceeds to Q41 in FIG. 5. The threshold α 1 for determining if the trouble has occurred is set based on the actual cooling water temperature at the time of starting the engine in Q41. Subsequently, the controller determines if the ratio of the heat amount R is more than the threshold α1 in Q42. If YES in Q42, the controller determines that the opening trouble has occurred in Q43 and then the alarm 11 is operated in Q44.

If NO in Q42, the threshold $\alpha 2$ for determining whether the condition is normal is set based on the actual cooling water temperature at the time of starting the engine in Q45 ($\alpha 1 > \alpha 2$). After this, the controller determines if the ratio of the heat amount R is less than the threshold $\alpha 2$ for determining if the condition is normal in Q46. If YES in Q46, the controller determines it to be normal condition that the opening trouble does not occur in Q47. If NO in Q46, the controller determines that it is impossible to determine if said condition is normal in Q48 since it can not be determined definitely if the opening trouble has occurred or not.

The setting of the threshold $\alpha 1$, $\alpha 2$ for determining based on the actual cooling water temperature at the time of starting the engine as described above is done with the same intention as that of Q5 in FIG. 3. (This compensates the raising gradient of the cooling water temperature being varied in response to the cooling water temperature at the time of starting the control.) The means for calculating the foregoing radiation heat amount Qorh and received heat amount Qig will be described after describing the flowchart in FIG. 6.

FIG.6 illustrates a flowchart for finally determining if the trouble has occurred based on the results of the determinations by the foregoing A and B types of means for determining if the trouble has occurred. First, the controller determines if the diagnosis for determining if the trouble has occurred by the A type diagnosis shown in FIG. 3 ends in Q51 in FIG. 6. If YES in Q51, a flag A is set at 1 to indicate that the diagnosis for determining if the trouble has occurred by the A type diagnosis ends in Q52. After Q52, the controller determines if the result of the determination if the trouble as occurred by the A type diagnosis is normal in Q54. If NO in Q54, the controller finally determines that the trouble (opening trouble) has occurred in Q58.

If NO in Q51, the process flow proceeds to Q55 after the flag A is reset to zero. If YES in Q54, the process flow also proceeds to Q55. The controller then determines if the diagnosis for determining if the trouble has occurred by the B diagnosis of means shown in FIGS. 4, 5 ends in Q55. If NO in Q55, the process flow returns to Q51. If YES in Q55, the controller determines if the result of the diagnosis for determining if the trouble has occurred by the B type diagnosis is normal in Q56. If NO in Q56, the controller finally determines that the trouble (opening trouble) has occurred in Q58.

If YES in Q56, the controller determines if the flag A is 1 in Q57. If NO in Q57, the process flow returns to Q51. If YES in Q57, the controller finally determines that diagnosis for determining if the trouble has occurred is normal in Q59. Thus, in summary, in an exemplary control in FIG.6, the controller finally determines that the diagnosis for determining if the trouble has occurred is normal only when both the results of the diagnoses for determining if the trouble has occurred by both the A and B types of diagnoses are normal, and such a diagnosis is finally determined to not be normal if the result of at least one of the diagnosis types is not normal.

Then, the ratio R of heat amount between the radiation heat amount Qorh and the received heat amount Qig employed in the B type diagnosis shown in FIG. 4 and FIG. 5 will now be described. As shown in the equation (16) derived as described below, the radiation heat amount Qorh is calculated based on the predicted cooling water temperature $\theta ep$ and the actual cooling water temperature $\theta$ ea, and the received heat amount Qig is calculated based on operating parameters indicating the operating condition of the engine 1.

The algebraic addition of the heat amount per hour transferred to the cooling water is proportional to the product of the heat capacity of the cooling water and the temperature rising ratio per hour. The following differential equation (1) (a thermal model basic equation of the cooling system) is derived by applying this relation to the thermal model of the cooling system shown in FIG. 1.

$$CMd\theta\frac{e}{dt} = qig - qoe - qor - qoh \tag{1}$$

where C is the specific heat of the cooling water (Kcal/Kg•K);

M is the mass of the cooling water (Kg);

$\theta e$ is the temperature of the cooling water (K);

qig is the heat amount per hour transferred from the burning gas to the cooling water (Kcal/s);

qoe is the heat amount per hour transferred from the surface of the engine to the atmosphere (Kcal/s);

qor is the heat amount per hour transferred from the surface of the radiator to the atmosphere (Kcal/s);

qoh is the heat amount per hour transferred from the surface of the heater core to the atmosphere (Kcal/s).

The heat amount per hour and the total heat amount transferred from the burning gas of the engine 1 to the cooling water can be calculated based on the calorific value of the fuel contributing to the burning of supplied fuel in accordance with the following equation (2).

$$qig = Rc\eta g(\gamma)Hu\gamma gf \tag{2}$$

where Rc is the ratio of the heat amount transferred to the cooling water to the supplied heat amount by the burning gas;

$\eta g$ is the ratio contributing to the rising of the burning gas temperature to the calorific value by the burning gas;

$\gamma = \lambda$ when $\lambda \geqq 1$, and $y = 1$ when $\lambda < 1$;

$\lambda$ is the excess air ratio of the burning gas;

gf is the amount of fuel supplied per hour (Kg/s);

Hu is the low level calorific value of the fuel (Kcal/Kg).

The heat amount per hour and the total heat amount transferred from the surfaces of the engine, the radiator, the heater core to the atmosphere can be calculated as shown in the equation (3) regarding the surface of the engine, as shown in the equation (4) regarding the surface of the radiator, and as shown in the equation (5) regarding the surface of the heater core.

$$qoe = koe(Vs)(\theta e - \theta ae) \tag{3}$$

where koe is the heat conductivity from the surface of the engine to the atmosphere;

vs is the vehicle speed (Km/h);

$\theta ae$ is the atmosphere temperature of the surface of the engine(K).

$$qor = kor(Vs)(\theta e - \theta ar) \tag{4}$$

where kor is the heat conductivity from the surface of the radiator to the atmosphere;

$\theta ar$ is the atmosphere temperature of the radiator(K).

$$qoh = koh(voh)(\theta e - \theta ah) \tag{5}$$

where koh is the heat conductivity from the surface of the heater core to the atmosphere;

voh is the flow velocity of the atmosphere passing through the heater core (Km/h); θah is the atmosphere temperature of the surface of the heater core (K).

The following differential equation (6) can be derived by assigning the equations (3)~(5) to the equation (1).

$$CMd\theta\frac{e}{dt} = qig - koe(Vs)(\theta e - \theta ae) - kor(Vs)(\theta e - \theta ar) - koh(voh)(\theta e - \theta ah) \quad (6)$$

Practically, the detection of the opening trouble is limited to carrying out in the opening range of the thermostat, and the subject of the thermal model of the cooling system is limited to being below the opening temperature of the thermostat for the purpose of simplicity. In the present vehicle system, the input information about θae, θar, θah, voh does not exist. Then θae, θar, θah are displaced to the intake air temperature θia respectively. Defining koh(voh) as a constant section when voh=0 and an increment section therefrom as shown in the following equation (7), the equations (8)~(10) are as follows.

$$koh(voh)=\Delta koh(voh)+koh0 \quad (7)$$

where Δkoh(0)=0

$$qoe=koe(Vs)(\theta e-\theta ia) \quad (8)$$

$$qor=kor(Vs)(\theta e-\theta ia) \quad (9)$$

$$qoh=[\Delta koh(voh)+koh0](\theta e-\theta ia) \quad (10)$$

Thus, the following equation (11) is derived from the equation (6)

$$CMd\theta\frac{e}{dt} = qig - k(Vs)(\theta e - \theta ia) - qorh \quad (11)$$

where $$qorh=qor+\Delta koh(voh)(\theta e-\theta ia)$$

$$k(Vs)=koe(s)+koh0$$

Assuming that it is unknown if the thermostat 5 works normally at present, namely, qorh is unknown, the following equation (12) can be derived from the equation (11) by defining the cooling water temperature at this time as the actual cooling water temperature detected by the sensor S1 (θe=θea).

$$CMd\theta\frac{ea}{dt} = qig - k(Vs)(\theta ea - \theta ia) - qorh \quad (12)$$

Then, assuming that the thermostat 5 works normally and that the blower for heating does not work, and that the cooling water temperature is unknown and θe=θep, the following equation (13) can be derived from the equation (11) since qorh=Qorh=0 by considering that the route to the radiator is cut off.

$$CMd\theta\frac{ep}{dt} = qig - k(Vs)(\theta ep - \theta ia) \quad (13)$$

Subtracting the equation (12) from the equation (13) and putting qorh in order, the following equation (14) is derived.

$$qorh = CM\frac{d(\theta ep - \theta ea)}{dt} + k(Vs)(\theta ep - \theta ea) \quad (14)$$

Integrating both terms of the equation (14), the following equation (15) is derived.

$$Qorh = CM(\theta ep - \theta ea) + \int_0^t k(Vs)(\theta ep - \theta ea)\,dt \quad (15)$$

Thus, the ratio of the heat amount R of Qorh to Qig is as shown in the following equation (16) in accordance with the equations (15),(2).

$$R = \frac{Qorh}{Qig} = \frac{CM(\theta ep - \theta ea) + \int_0^t k(vs)(\theta ep - \theta ea)\,dt}{\int_0^t qig\,dt} \quad (16)$$

The left term of the numerator in the above equation (16) indicates a deviation between the present predicted cooling water temperature and the actual cooling water temperature, and the right term of the numerator indicates an integrating value of the deviation between both temperatures (an integrating value of a value multiplied by the vehicle speed). Thus, the radiation heat amount Qorh can be calculated based on the predicted cooling water temperature and the actual cooling water temperature. The heat from the radiator 3 (the opening of the thermostat 5) can be assumed since the greater the ratio of heat amount is, the greater the heat amount Qorh is.

The present invention is not limited to the above embodiment. That is, it also includes the following exemplary cases although one embodiment has been described. The alarm 11 can be operated only if the controller finally determines that the trouble has occurred in FIG. 6, and it can not be operated in a case where the determination on whether the trouble has occurred has been made in FIGS. 3, 4, 5. The control only for the determination on whether the trouble has occurred based on the radiation heat amount from the radiator as shown in FIGS. 4, 5 may be carried out. Furthermore, the actual temperature can be used in place of the predicted temperature in step Q30 of FIG. 5. Preferably, the parameters indicating the operating condition of the engine used to calculate the radiation heat amount Qorh and the received heat amount Qig include at least either the engine load such as the intake air volume or air-fuel ratio to provide each heat amount precisely.

The apparatus at the present invention may also be set to stop the making of the determination on whether the trouble has occurred when the vehicle speed is at a lower speed than the predetermined value in the control shown in FIGS. 4, 5. The means for stopping the making of the determination on whether the trouble has occurred include not only means for stopping the making of the determination on whether the trouble itself has occurred but also means for stopping the result of the determination on whether trouble has occurred from being utilized while the determination on whether trouble has occurred is being made. (The operation of the alarm 11 is not stopped or the result of the determination on whether trouble has occurred is not stored as a diagnostic check used at the time of maintenance and inspection, even if the determination that trouble has occurred is made.)

The determination on whether a closing trouble of the thermostat 5 has occurred can be made. In this case, the determination on whether the closing trouble of the thermostat 5 can be made when the predicted or actual temperature is more than the opening set temperature of the thermostat 5 and the ratio of heat amount R is less than the predetermined threshold value for determination and the radiation heat amount from the radiator 3 is insufficient. In the control as shown in FIGS. 4, 5, the plural steps of predicted temperature (ex. 50 °C., 65° C., 76° C.) may be set at exactly the time that the determination on whether trouble has occurred is made in order to make the determination on whether said above trouble has occurred correctly as well as the trouble that the thermostat 5 is opened at a lower temperature (ex. 65° C.) than the opening set temperature (ex. 80° C.). Thus, the controller can determine if the opening trouble occurs by comparing the predetermined threshold for the determination. and the ratio of heat amount R each of which are set independently at each step. (In addition to this or in place of this, it is also possible to determine quite precisely at when the thermostat 5 opens by monitoring a condition under when the ratio of heat amount R changes.)

Taking the operating condition of an air conditioning system into account, it is possible to amend the control value for the determination on whether the trouble has occurred, for example, the radiation heat amount Qorh, the received heat amount Qig. That is, the only radiation heat amount from the heater core 9 may be subtracted from the radiation heat amount Qorh from the radiator 3 at the time of heating. The only heat loss of the pump for cooling driven by the engine may be subtracted from the received heat amount Qig at the time of cooling. The change in response to the operating condition of the air conditioning system can be the same as that of the threshold for the determination on the trouble has occurred.

Each step (the group of steps) shown in the flowchart or a variety of members such as a sensor and switch can be indicated by names which generally indicate for the function thereof. The function of each step (the group of steps) shown in the flowchart can be indicated as the function of the functional part set in the control unit (controller)(the presence of the functional part). Finally, while a preferred embodiment of the present invention has been described with reference to the drawings, obvious modifications and variations one possible in light of the above teachings. It is therefore to be understood that within the scope of the appended claims, the invention may be practiced otherwise than as specifically described. Furthermore, the present invention can be utilized in a method for determining whether the trouble has occurred.

What is claimed is:

1. An apparatus for diagnosing a thermostat trouble in an engine cooling system comprising a thermostat which opens a valve to make a cooling water flow through a radiator when the cooling water temperature for an engine becomes more than a predetermined temperature, and closes the valve to make the cooling water bypass the radiator when the temperature becomes less than the predetermined temperature, the apparatus comprising:

calculating means for calculating a radiation heat amount from a radiator based on a predicted cooling water temperature calculated by using operating parameters indicating a condition of the engine operation and an actual cooling water temperature detected by a detecting means for detecting a temperature, and based on an integrating value of deviation between the predicted temperature and the actual temperature and a deviation between a present predicted temperature and the actual temperature; and determining means for determining whether the thermostat trouble has occurred, based on a result of the comparison between the actual or predicted temperature and a predetermined temperature, and the radiation heat amount calculated by the calculating means.

2. The apparatus of claim 1 further comprising a second calculating means for calculating the heat amount from the engine received by the cooling water for the engine, wherein the determining means is configured to determine whether the thermostat trouble has occurred based on a relation between the radiation heat amount and the received heat amount.

3. The apparatus of claim 1 wherein the integrating value is a value derived from multiplying the deviation between the predicted temperature and the actual temperature by a vehicle speed, the apparatus further comprising:

a second calculating means for calculating the heat amount from the engine received by the cooling water for the engine, wherein the determining means for determining whether the thermostat trouble has occurred is configured to determine if the thermostat trouble has occurred by comparing a ratio of the radiation heat amount to the received heat amount with a predetermined threshold for determination.

4. The apparatus of claim 1 wherein the determining means for determining whether the thermostat trouble has occurred is configured to determine that the thermostat trouble has occurred and left open the valve when the predicted temperature or the actual temperature is less than an opening set temperature of the thermostat and when the ratio of the heat amount is more than the threshold for determination.

5. The apparatus of claim 1 wherein the determining means for determining whether the thermostat trouble has occurred is configured to determine that the thermostat trouble has occurred and left close the valve when the predicted temperature or the actual temperature is more than the opening set temperature of the thermostat and when the ratio of the heat amount is less than the threshold for determination.

6. The apparatus of claims 1 further comprising a stopping means for stopping the determination of whether the thermostat trouble has occurred by the determining means for determining whether the thermostat trouble has occurred when the cooling water temperature is less than the predetermined value or when the vehicle speed is less than the predetermined value.

7. An apparatus for diagnosing a thermostat trouble in an engine cooling system comprising a thermostat which opens a valve to make a cooling water flow through a radiator when the cooling water temperature for an engine becomes more than a predetermined temperature, and closes the valve to make the cooling water bypass a radiator when the temperature becomes less than the predetermined temperature, the apparatus comprising a controller configured to:

calculate a radiation heat amount from a radiator received based on a predicted cooling water temperature calculated by using operating parameters indicating a condition of the engine operation and an actual cooling water temperature detected by means for detecting a temperature, and also based on an integrating value of deviation between the predicted temperatures and the actual temperature, and a deviation between a present predicted temperature and the actual temperature; and determine whether the thermostat trouble has occurred based on the result of a comparison between the actual or predicted temperature and a predetermined temperature the calculated radiation heat amount.

8. The apparatus of claim 7 wherein the controller is configured to calculate the heat amount from the engine received by the cooling water for the engine and determine whether the thermostat trouble has occurred based on a relation between the radiation heat amount and the received heat amount.

9. The apparatus of claim 7 wherein the integrating value is a value derived from multiplying the deviation between the predicted temperature and the actual temperature by a vehicle speed, the apparatus comprising a controller configured to:

calculate the heat amount from the engine received by the cooling water for the engine; and determine if the thermostat trouble has occurred by comparing a ratio of the radiation heat amount to the received heat amount with a predetermined threshold for determination.

10. The apparatus of claim 7 wherein the controller is configured to determine that the thermostat trouble has occurred and left open the valve when the predicted temperature or the actual temperature is less than an opening set temperature of the thermostat and when the ratio of the heat amount is more than the threshold for determination.

11. The apparatus of claim 7 wherein the controller is configured to determine that the thermostat is not normal and left closed the valve when the predicted temperature or the actual temperature is more than the opening set temperature of the thermostat and when the ratio of the heat amount is less than the threshold for determination.

12. The apparatus of claim 7 wherein the controller configured to stop the determination of whether the thermostat trouble has occurred when the cooling water temperature is less than the predetermined value or when the vehicle speed is less than the predetermined value.

* * * * *